US006860095B2

(12) United States Patent
Tao et al.

(10) Patent No.: US 6,860,095 B2
(45) Date of Patent: Mar. 1, 2005

(54) MANUFACTURING METHOD AND APPARATUS FOR TORQUE-FREE SINGLES RING SPUN YARNS

(75) Inventors: Xiaoming Tao, Hong Kong (CN); Bingang Xu, Hong Kong (CN)

(73) Assignee: The Hong Kong Polytechnic University, Kowloon (HK)

( * ) Notice: Subject to any disclaimer, the term of this patent is extended or adjusted under 35 U.S.C. 154(b) by 132 days.

(21) Appl. No.: 10/290,507

(22) Filed: Nov. 8, 2002

(65) Prior Publication Data

US 2003/0200740 A1 Oct. 30, 2003

(30) Foreign Application Priority Data

Apr. 24, 2002 (CN) ..... 2118588 A

(51) Int. Cl.[7] ..... D01H 7/52

(52) U.S. Cl. ..... 57/75; 57/332; 57/350; 57/1 R

(58) Field of Search ..... 57/1 R, 66, 75, 57/200, 236, 314, 362, 332–350

(56) References Cited

U.S. PATENT DOCUMENTS

| | | | | | |
|---|---|---|---|---|---|
| 4,384,448 | A | * | 5/1983 | Wilkie | 57/200 |
| 4,574,579 | A | * | 3/1986 | Chao | 57/328 |
| 5,170,619 | A | * | 12/1992 | Noda | 57/328 |
| 5,848,524 | A | * | 12/1998 | Lappage et al. | 57/315 |
| 6,012,277 | A | * | 1/2000 | Prins et al. | 57/315 |
| 6,131,382 | A | * | 10/2000 | Dinkelmann et al. | 57/315 |

OTHER PUBLICATIONS

M.D. De Araujo et al., Spirality of Knitted Fabrics, Part II: The Effect of Yam Spinning Technology on Spirality, Textile Research Journal, Jun. 1989, pp. 350 –356,vol. 59, No. 6, Textile Research Institute, USA.

A. Barella et al., Friction Spun Yarns Versus Ring and Rotor Spun Yarns: Resistance to Abrasion and Repeated Extensions, Textile Research Journal, 1989, pp. 767–769, vol. 59, No. 12, Textile Research Institute, USA.

P.R. Lord et al., The Performance of Open–end, Twistless, and Ring Yarns in Weft Knitted Fabrics, Textile Research Journal, 1974, pp. 405–414, vol. 44, No. 7, Textile Research Institute, USA.

A.K. Sengupta et al., Structure of Fiber Assembly During Yarn Formation in Rotor Spinning, Textile Research Journal 1994, pp. 692–694, vol. 64, No. 10, Textile Research Institute, USA.

A. Barella et al., Predicting "Machine Twist" in Rotor Open–end Spun Cotton Yarns, Textile Research Journal, 1988, pp. 425–426, vol. 58, No. 7, Textile Research Institute, USA.

(List continued on next page.)

*Primary Examiner*—John J. Calvert
*Assistant Examiner*—Shaun R Hurley
(74) *Attorney, Agent, or Firm*—Burns, Doane, Swecker & Mathis, L.L.P.

(57) ABSTRACT

An internal torque balancing method of short fiber yarns related to the art of textile and the manufacturing apparatus thereof. The present invention proposes a completely new mechanical processing method of single torque-free yarns, and applies it into the process of ring spinning. Said method accomplishes a machine and a possibility of processing single torque-free yarns within one processing step by simple improvement on the existing ring spinning machine. Said technique is applicable to the production of all types of short fiber materials, and can overcome the maximum bundle yarn count of Ne limit of the torque-free yarns processed by the existing physical balancing technique. Meanwhile, said technique can process the yarns with low twist, which is unable to be processed normally by the conventional ring spinning machine. The torque-free singles ring spinning machine has good mechanical behavior, good handle, and evenness without residual torque.

6 Claims, 6 Drawing Sheets

OTHER PUBLICATIONS

Yin–Mei Lau et al., Spirality in Single–Jersey Fabrics, Textile Asia, 1995, pp. 95–96,101–102, vol. XXVI, No. 8, Hong Kong Business Press, Hong Kong.

A.P.S. Sawhney et al., Tandem Spinning. Textile Research Journal, 1995, pp. 550–555, vol. 65, No. 9, Textile Research Institute, USA.

A.P.S. Sawheny et al., Improved Method of Producing a Cotton Covered/Polyester Staple–core Yarn on a Ring Spinning Frame, Textile Research Journal 1992, pp. 21–25, vol. 62, No. 1,Textile Research Institute, USA.

X.M.Tao et al., Torque–Balanced Singles Knitting Yarns Spun by Unconventional Systems, Part I: Cotton Rotor Spun Yarn, Textile Research Journal, 1997, pp. 739–746, vol. 57, No. 10, Textile Research Institute, USA.

* cited by examiner (a)

(b)

(a)

(b)

(a)

(b)

MANUFACTURING METHOD AND APPARATUS FOR TORQUE-FREE SINGLES RING SPUN YARNS

TECHNICAL FIELD

The present invention belongs to the technical zone of internal torque balancing of the short fibre yarns, further relates to the zone of controlling the spinning and knitting processes of the spinning machine.

BACKGROUND ART

Twisting is an important step of short fibre spinning. In this process, the yarns, are elastically twisted and transformed to attain sufficient strength, wear resistance and smoothness. However, as a negative effect, a large amount of residual torque or twist liveliness is also brought about in the yarns simultaneously. Such twist liveliness of the yarns renders a significant influence on the possessing quality of the latter products. For example, if yarns with twist liveliness are used on knitting, loops of the fabric will lose their balance because of the variation of torsion stress in the yarns. In order to attain the natural structure with the minimum energy condition, the loops tend to rotate to release the internal torsion stress. As a result, one end of the loops will tilt and protrude from the fabric surface, while the other end will stay inside the fabric. Such deformation of the loops will increase the spirality of the fabric; a deformation similar to the rib effect, which should be prevented to the utmost in the spinning industry. Thus, the balancing of torque inside the yarns is particularly important.

Yarns are made from a large quantity of fibres polymerized by their friction inbetween. Hence, the residual torque of the yarns or the spirality of the fabric is mainly affected by said characteristic of the fibres, such as the type and cross sectional shape of the fibres, the polymerizing manner of the fibres and the internal structure of the yarns, etc.

First of all, different types of fibres have a different modulus (i.e. tensile, bending and shear) and cross sectional shape, thus lead to different degree of stress in the yarns. According to the report of Arauj and Smith in the Textile Research Journal, Vol. 59, No. 6, 1989, in the cotton/polyester blended yarns, increasing the ratio of polyester will enhance the twist liveliness of rotor and ring yarns, thus improving the spirality of the yarns. This is because polyester has a higher modulus, and said two types of fibre has different cross sectional shapes.

Next, different yarn structures have a different distribution of stress. Experimental results, such as Barella and Manich in the Textile Research Journal, Vol. 59, No. 12, 1989, Lord and Mohamed in the Textile Research Journal, Vol. 44, No. 7, 1974 and Sengupta, and Sreenivasa in the Textile Research Journal, Vol. 64, No 10, 1994 show that, friction yarns (DREF-II) has the largest residual torque and trend of deformation in the priority sequence as ring yarns, rotor yarns and air-jet yarns. The different residual torques of said four types of yarn show the difference among their structures. It is generally agreed that single ring yarns are composed of a plurality of uniformly enveloped concentric helical threads, which fibre migration is a secondary feature. Hence, when the ring yarns are reverse-twisted, their strength will gradually decrease to zero, by then the yarns will be all dispersed. In relative to ring yarns, unconventional spinning system produce yarns with core-sheath structures, such as rotor spinning yarn, air jet spinning yarn and friction spinning yarns. The packing density of said yarns is uneven, mainly characterized in the partial entanglement and enwrapment of the fibres. As a result, during reverse twisting, the strength of said yarns would not be completely disappeared, as disclosed in the Textile Research Journal, Vol. 58, No. 7, 1988 by Castro etc.

In addition, many factors can affect the degree of movement freedom of the loops of the fabric and also the final spirality of the fabric. Said factors include fabric structure, parameters of the knitting machine, and the fabric relaxation and fabric setting due to finishing. All the aforesaid factors affecting the spirality of fabric are reported in detail as disclosed by Lau and Tao in the Textile Asia, Vol. XXVI, No. 8, 1995.

Same as other materials, the residual torque of the yarns can be reduced or eliminated with different methods. In the past several ten years, a variety of torque balancing methods have been developed. According to basic theory, they can generally refer to two categories: permanently processing method and physical torque balancing method.

Permanently processing method mainly accomplishes the purpose of releasing residual torque by transforming the elastic torsional deformation into plastic deformation. Said method mainly relates to all sorts of processing technique of material, such as thermal processing, chemical processing and wet processing etc. In the Textile Research Journal, Vol. 59, No. 6, 1989, Araujo and Smith have proved that in relative to air-jet and rotor yarns, the heat processing of single cotton/polyester blended yarns can effectively reduce the residual torque of the yarns, However, in relative to natural fibres such as cotton or wool, permanent processing is too complicated. It may involve stream processing, hot water processing and chemical processing (such as mercerization in the case of cotton yarns and treatment with sodium bisulphite in case of the wool yarns) In addition, in relative to natural yarns, permanent processing cannot completely eliminate the residual torque of the single yarns; meanwhile it may cause damage and abruption to the yarns.

In relative to permanent processing, physical torque balancing is a pure mechanical processing technique. The main point of said method is fully utilizing the structure of yarns to balance the residual torque generated in different yarns while maintaining the elastic deformation characteristic of the yarns. Currently in the industry, separate machines are required to enforce torque balancing of the yarns; the cost is thus higher. Said method comprises plying two identical singles yarns with a twist equal in number but in the opposite direction to that in the singles yarns; or feeding two singles yarns with twist of the same magnitude but in opposite direction onto the same feeder.

Recently, some new torque balancing methods for yarns also emerges. In the Textile Research Journal, Vol. 65, No. 9, 1995, Sawhney and Kimmel has designed a series spinning system for processing torque-free yarns. The inner core of said yarns is formed by processing with an air-jet system while outside the core is enwrapped with crust fibres similar to DREF-III yarns. In the Textile Research Journal, Vol. 62, No. 1, 1992, Sawhey etc. have suggested a method of processing ring cotton crust/polyester inner core yarns Said yarns accomplish balancing condition by utilizing core yarns with opposite twisting direction from synthetic yarns, or applying heat processing on the polyester portion of said yarns. However, it is readily seen that the machines and processing techniques related to the aforesaid method are generally more complicated. In the Textile Research Journal, Vol, 57, No. 10, 1997, Tao has processed the layer structure of the inner core-crust of rotor yarns to generate torque-free single yarns, yet said technique is not suitable for ring yarns.

CONTENTS OF THE INVENTION

The purpose of the present invention is to overcome the defects and shortages of the prior art herein above by proposing a completely new mechanical processing method of single torque-free yarns, and applying it into the art of ring spinning. The basic theory of said method is to process the single yarns with controllable multi-bundle fibre structure, and make the sum of residual torque $$\left(\sum_{j=1}^{N} M_j\right)$$

produced by N fibre bundles in the yarns balanced with the residual torque (M) of the whole synthetic single yarns, i.e.

$$\sum_{j=1}^{N} M_j - M = 0.$$

The technical solution of said method is to install a fibre bundle-spitting mechanism and a false twisting device on to a conventional ring spinning machine; said fibre bundle-spitting mechanism is placed preceding the spinning triangular zone for splitting a roving into a plurality sub-fibre bundles; the false twister is installed between a front roller and a ring traveller of the ring spinning machine for false twisting the sub-fibre bundles before true twisting of the original ring spinning machine, and then attaining balance of the internal torque of the final yarns by regulating the rotating speed of the false twister.

The mechanical processing method for single torque-free yarns provided by the present invention develops a new way on the art of balancing the internal torque of short fibre yarns. It shows the following advantages:

1. Since the improvement of said method on the current ring spinning machines spinning machine only relates to installing a fibre bundle-spitting mechanism and a false twister, said technical method is simple and convenient, the versatility is strong.

2. Said technique can generate single torque-free yarns in one spinning machine with one processing step, hence comparing to the traditional torque balancing method, said method has the advantages of saving processing time and reducing processing cost, under the condition of attaining the same torque-free yarns.

3. The single torque-free yarns processed by said method can break through the maximum yarn count of Ne limit of the torque-free yarns produced by the existing physical balancing technique.

4. Since said method is to install a false twister onto a conventional ring spinning machine, it can enhance the torque of the spinning triangular zone, improve the strength of the yarns, thus ensures the yarns in normal spinning under low twist multiplier. Hence, said method can generate yarns with low twist, which is unable to be obtained by traditional ring spinning machine.

5. Since said technique is a pure mechanical technique, it can be applied to all types of short fibre material production, such as cotton, wool and synthetic fibre etc. In addition, said method can prevent damage or deterioration of fibres caused by heat or chemical processing etc. in such as permanent processing.

BRIEF DESCRIPTION OF FIGURES

FIG. 5(*b*) is the top view of the mechanical false twister shown in FIG. 5(*a*);

FIG. 6(*b*) is the top view of the mechanical false twister shown in FIG. 6(*a*);

FIG. 7(*b*) is the cross-sectional view along S—S in FIG. 7(*a*);

FIG. 9(*b*) is the cross-sectional view along S—S in FIG. 9(*a*);

Figure 1:
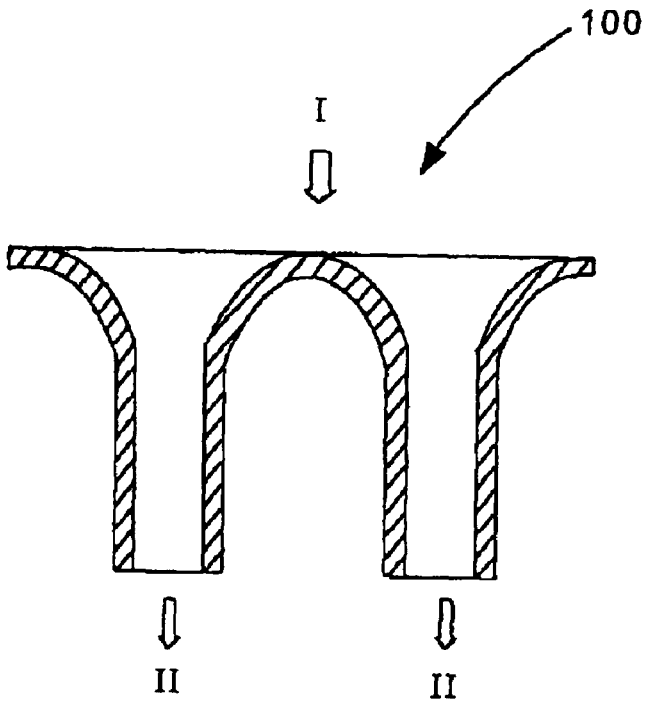
FIG. 1 is the structural schematic view of a two-bundle separate-feeding mechanism for roving.

In the Figures,

1. driven rotor; 2. bed frame; 3. guide tube; 4. driving belt; 5. electric motor; 6. driving rotor; 7. magnet; 8. pin(s); 9. coupling hinge; 10. curve flute; 11. a cylinder-half, 12; another cylinder-half; 13. compressed air; 14. a tangential direction indicating the compressed air entering; 15. a fibre bundle having Z-twist; 16. another fibre bundle having Z-twist; 17. composite single yarns having S-twist; 18. roving; 19. sub-fibre bundles forming synthetic single yarns under twisting of the false twister; 20. single yarns (19) after reverse twisting; 21. resultant yarn sample; 22. showing control of the rotating speed of the false twister based on the residual torque of the resultant yarn sample (21); 100. double-bundle separate-feeding mechanism of roving; 200. a multi-bundle spitting mechanism of untwisted yarns; 300. another multi-bundle spitting mechanism of untwisted yarns; 400. mechanical false twisting device; 500. a mechanical false twister; 600. another mechanical false twister; 700. air-jet false twister; 800. ring traveller of the ring spinning machine; 900. showing the residual torque test of the wet-twisting method of the resultant yarn sample (21); 1000. ring spinning machine; 2000. double-stage multi-bundle spitting mechanism for untwisted yarns; 3000. Yarn drafting device; 4000. sub-fibre bundles obtained after roving split through multi-bundle spitting mechanism; 5100. A group of fibre bundle obtained by sub-fibre bundle of a rove bundle passing through a first stage twisting of double-stage multi-bundle spitting mechanism; 5200. Another group of fibre bundle obtained by sub-fibre bundle of another rove bundle passing through a first stage twisting of double-stage multi-bundle spitting mechanism; 6000. A yarn obtained on the action of a second stage twisting of double-stage multi-bundle spitting mechanism for the two groups of fibre bundles. I. showing the entrance direction of the fibre bundles (or the yarns); II. showing the exit direction of the fibre bundles (or the yarns); $M_1$. the internal torque generated in the fibre bundle (15); $M_2$. the internal torque generated in the fibre bundle (16); M. the internal torque generated in the synthetic single yarns (17).

DETAILED DESCRIPTION OF THE PREFERRED EMBODIMENTS

The method of the present invention will be illustrated in details hereunder accompanying with the figures.

In FIG. 1, a double-bundle separate-feeding mechanism (100) of roving can installed preceding a yarn drawing/drafting zone and a spinning triangular zone of the ring spinning machine to split two bundles of roving with a certain distance. The roving enter the two-bundle separate-feeding mechanism (100) from the entrance direction (I), are separated with a certain distance and exit from the exit direction (II), and then enter from the back of the drafting zone.

Figure 2:
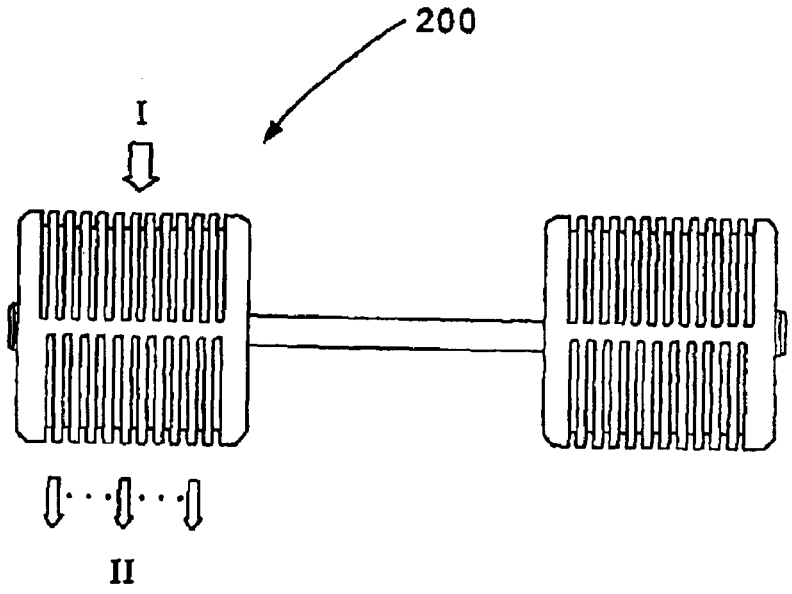
FIG. 2 is the structural schematic view of a multi-bundle spitting mechanism for untwisted yarns.
Figure 3:
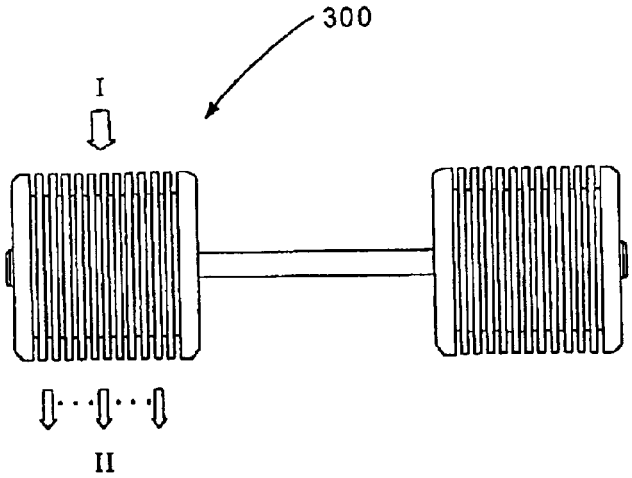
FIG. 3 is the structural schematic view of another multi-bundle spitting mechanism for untwisted yarns.

In FIGS. 2 and 3, a multi-bundle spitting mechanism (200 or 300) of untwisted yarns is installed on to the drafting frame of the ring spinning machine behind the drafting zone and preceding the spinning triangular zone for splitting the untwisted yarns into a plurality of sub-fibre bundles. The multi-bundle spitting mechanism (200 or 300) contacts with front roller(s) of the ring spinning machine and is driven to rotate. After drafting, the untwisted yarns enter the multi-bundle spitting mechanism (200 or 300) from the entrance direction (I) into a plurality of discontinuous (200) or continuous (300) flutes disposed annular on the rollers, afterwards they are separated into a plurality of sub-fibre bundles, finally each of the sub-fibre bundles are drawn out from the exit direction (II) into the back of the spinning triangular zone.

Figure 4:
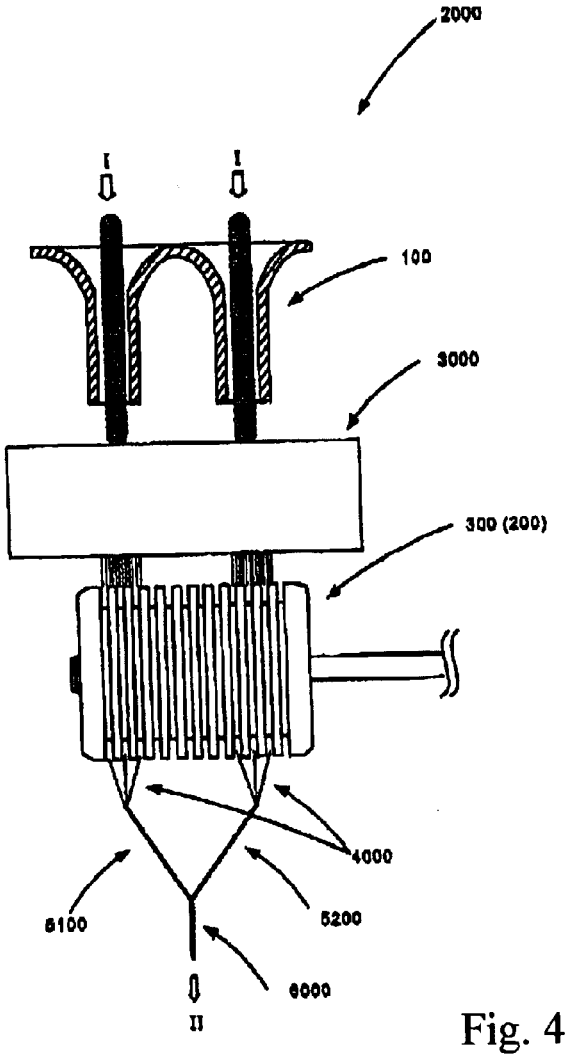
FIG. 4 is the structural schematic view of double-stage multi-bundle spitting mechanism for untwisted yarns.

In FIG. 4, a double-stage multi-bundle spitting mechanism (2000) is composed of a double-bundle separate-feeding mechanism (100) installed preceding the yarn drawing/drafting zone and a multi-bundle spitting mechanism (200 or 300) positioned between the yarn drawing/drafting zone and the spinning triangular zone. Firstly, two bundles of roving are split with a certain distance by the double-bundle separate-feeding mechanism (100) and then are drafted into widen fibre bundles by a yarn-drafting device (3000) and afterwards are fed into the multi-bundle spitting mechanism (200 or 300). Fibre bundles of the two widen bundles are respectively split into several sub-fibre bundles (4000) by the multi-bundle spitting mechanism (200 or 300) and then fabricated into a yarn (6000) on the action of through the double stage twisting. The double-stage multi-bundle spitting mechanism (2000) has a double stage yarn spinning triangular zone, where the first stage spinning triangular zone is to twist several sub-fibre bundle (4000) of the two bundle of roving respectively into two groups of fibre bundles (5100 and 5200), and the second spinning triangular stage is to twist the two groups of fibre bundles (5100 and 5200) twisted at the first stage spinning triangular zone into a yarn (6000).

Figure 5:
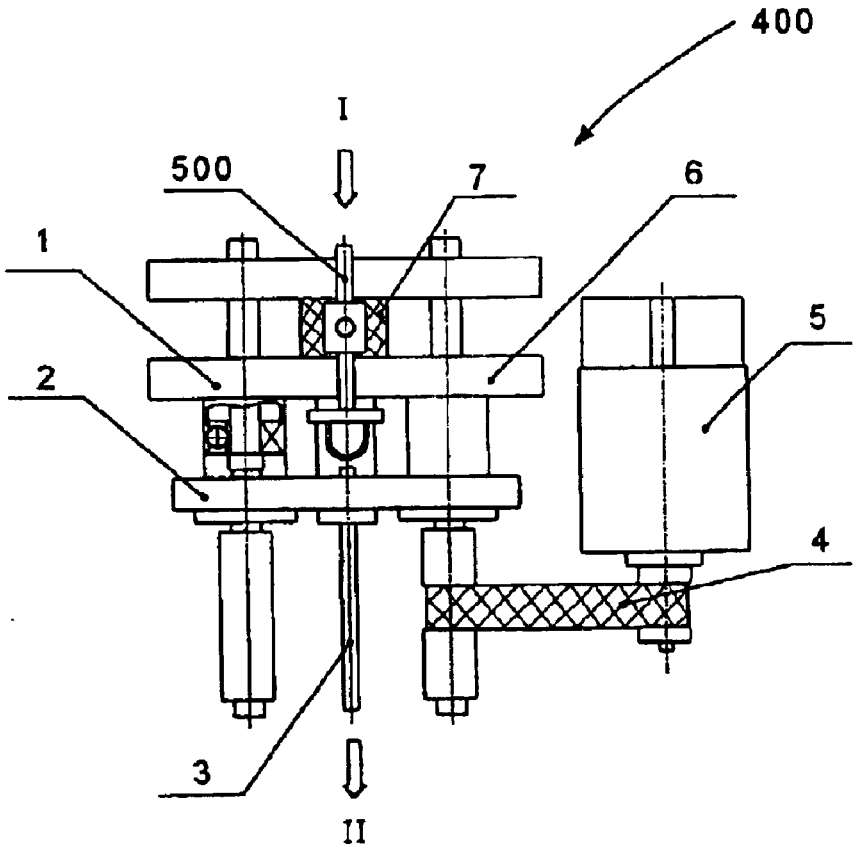
FIG. 5(*a*) is the front view of a mechanical false twister.
Figure 5:
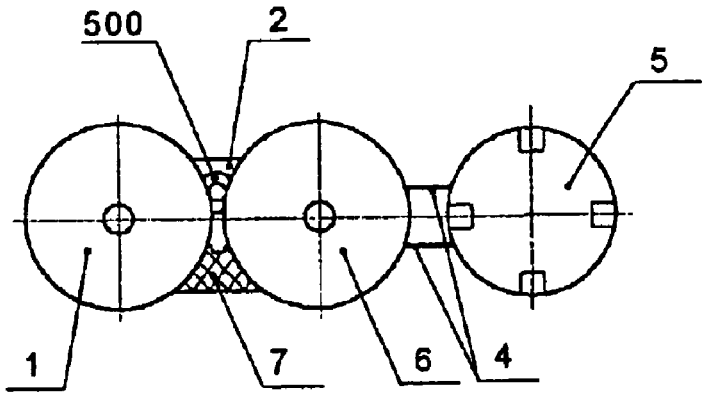
Figure 6:
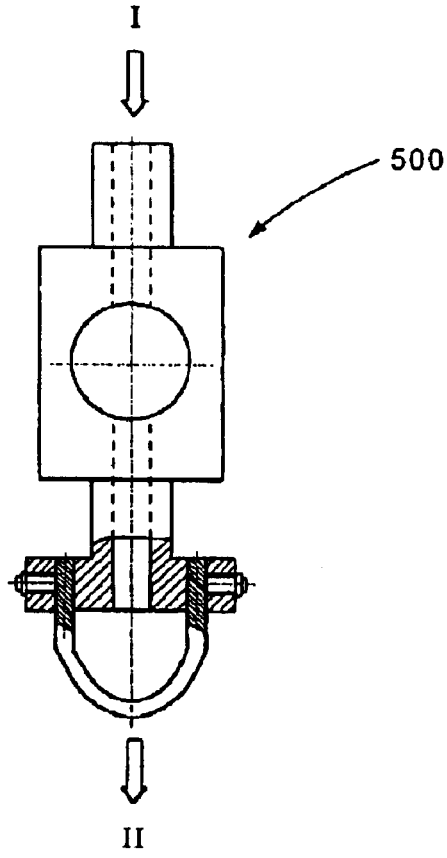
FIG. 6(*a*) is the enlarged front view of the mechanical false twister shown in FIG. 5(*a*)
Figure 6:
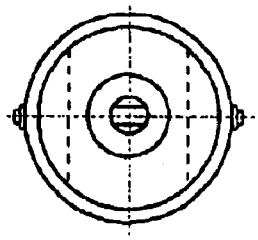
Figure 7:
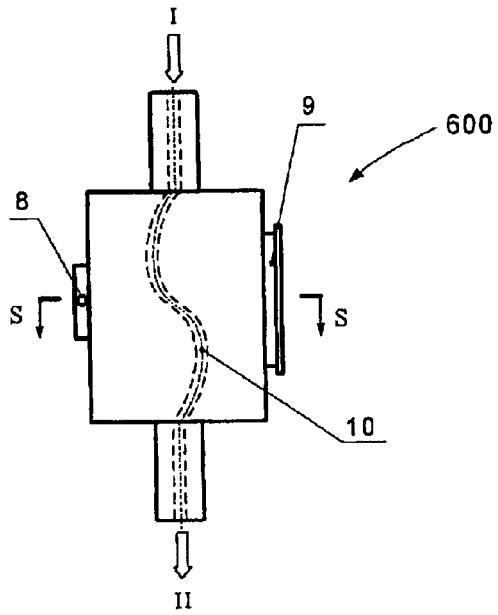
FIG. 7(*a*) is the front view of another mechanical false twister.
Figure 7:
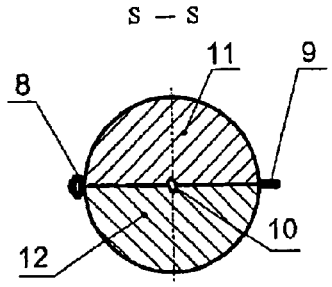

In FIGS. 5, 6 and 7, the driving rotor (6), driven rotor (1), guide tube (3) and magnet (7) are secured onto the bed frame (2). The bed frame (2) is further secured together with the electric motor (5) onto a steel collar to form a false twisting device (400). The false twisting device (400) can be installed between the front roller and the ring traveller of the ring-spinning machine. Under the sorption of the magnet (7), the false twister (500 or 600) is in close contact with the driving rotor (6) and the driven rotor (1). The electric motor (5) drives the driving rotor (6) to rotate via the driving belt (4). Further, the driving rotor drives the false twister (500 or 600) together with the driven rotor (1) to rotate at high speed by means of friction. The yarns enter the false twister (500 or 600) from the entrance direction (I) and is twisted by the turning effort of the false twister (500 or 600). Twisted yarns are drawn out from the exit direction (II) via guide tube (3).

In FIG. 7, another false twister (600) is composed of two cylinder-halves (11 and 12) provided with curve flutes (10). Said two cylinder-halves (11 and 12) are coupled with a hinge (9) and secured with pins (8). Said false twister (600) can be opened and closed for installing yarns. After removing the pins (10), yarns can be placed into the curve flutes (10) for twisting. Said yarns have a frictional length inside the curve flutes (10). The yarns enter the false twister (600) from the entrance direction (I) and being twisted under the turning effort of the false twister (600), finally being drawn out from the exit direction (II).

Figure 8:
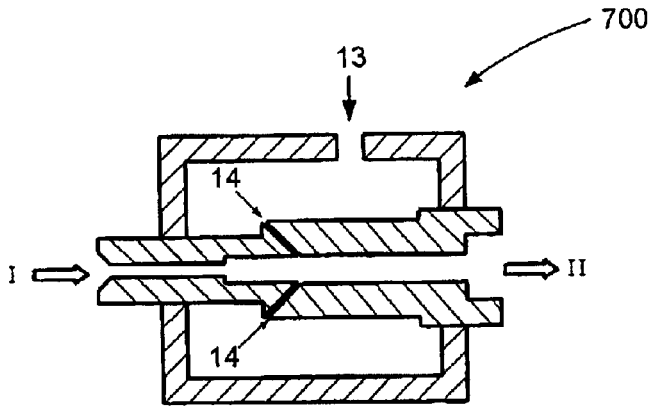
FIG. 8 is the cross-sectional schematic view of an air-jet false twister.

In FIG. 8, an air-jet false twister (700) can be installed between the front roller and the ring traveller of the ring spinning machine, wherein compressed air (13) enters the air-jet false twister (700) along a tangential direction (14) into a twisting area. The yarns enter the air-jet false twister (700) from an entrance direction (I) and being twisted with the tangential direction (14) under the drive of the compressed air (13), finally being drawn out from an exit direction (II).

Figure 9:
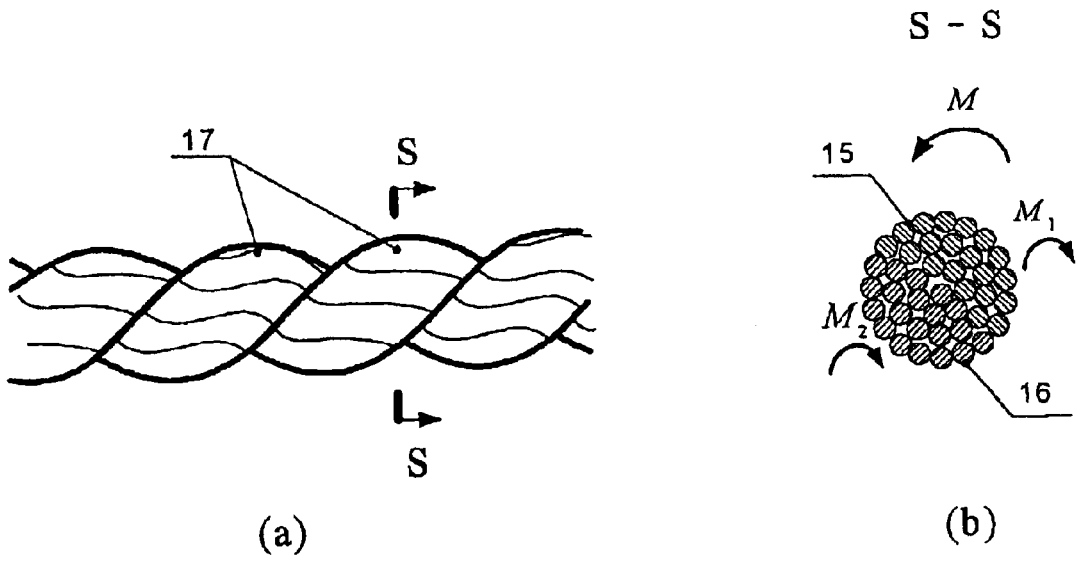
FIG. 9(*a*) is the schematic view of the torque balance of a single yarn having a doubled fibre structure.

In FIG. 9, single yarns (17) are composed of two bundles of fibres (15, 16). The sum of the internal torque ($M_1+M_2$) generated by a fibre bundle having Z twist (15) and another fibre bundle having Z twist (16) is in equilibrium with the internal torque of the synthetic single yarns having S twist (17) composed thereof, i.e. $M_1+M_2-M=0$.

Figure 10:
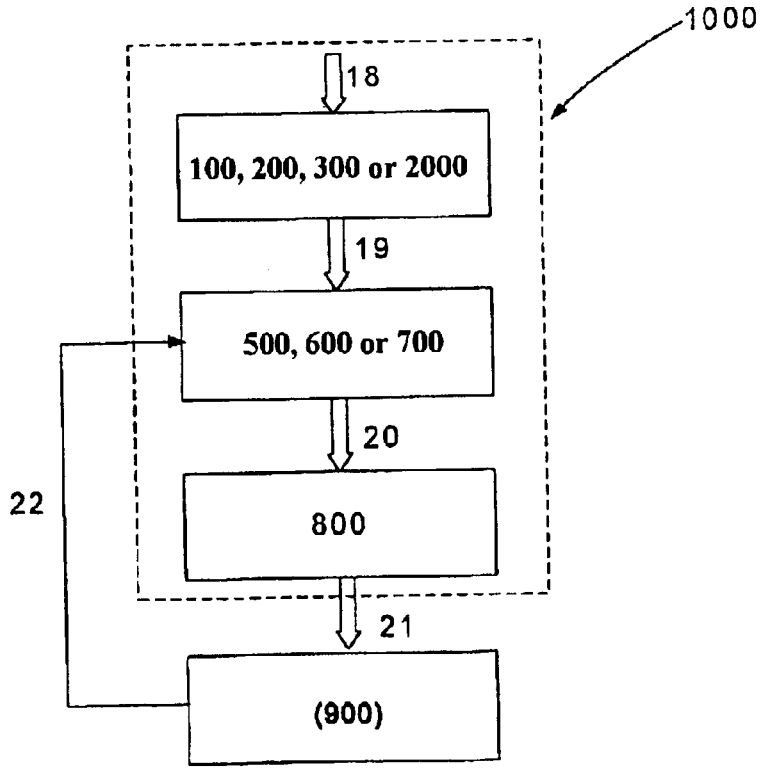
FIG. 10 is the process schematic view of the torque balance of a single yarn having a multi-bundle fibre structure.

In FIG. 10, The method of the present invention is comprise the steps of: installing the fibre-spitting mechanism (100, 200, 300, 2000) preceding the spinning triangular zone of the ring spinning mechanism (1000) to split the roving (18) into a plurality of sub-fibre bundles; meanwhile, installing a false twister (500, 600 or 700) between the front roller and the ring traveller (800) of the ring spinning machine. The rotating direction of said false twister (500, 600 or 700) is same as the ring traveller (800). Its purpose is to false twist the fibre bundles before true twisting of the original ring spinning machine, and to manually control the rotating speed of the false twister (500, 600 or 700) based on the result of the wet-twisting test of the residual torque on the resultant yarn sample (21), thus the twisting direction of each fibre bundle is opposite to the single yarns composed thereof, and the sum of the residual torque generated by each fibre bundle is in equilibrium with the residual torque of the whole composite single yarn. The process of the present method is illustrated in details hereunder accompanying with FIG. 10.

1. Prior to the spinning triangular zone, the fibre bundle-splitting mechanism (100, 200 or 300) splits the roving into two or more sub-fibre bundles;
2. In the spinning triangular zone, each the fibre bundle gains a twist value by the action of the false twister (500, 600 or 700), and then synthesizes into single yarns (19). Meanwhile, each fibre bundle inside the yarns has the same twisting direction as the yarns synthesized thereby;
3. Between the false twister (500, 600 or 700) and the ring traveller (800) of the ring spinning machine, each sub-fibre bundle and the single yarns (19) synthesized thereby are reverse-twisted simultaneity, thus a reverse-twist value is formed on each sub-fibre bundle and the single yarns (19) synthesized, which become single yarns (20), and finally winded on the spindle of the spinning machine;
4. Wet twisting method (900) is used to test the residual torque of the resultant yarn sample (21). Afterwards, the rotating speed of the false twister (500, 600 or 700) is (manually) regulated according to the amount of residual torque in the resultant yarn sample (21);
5. Steps 1–4 are repeated until the residual torque of the yarns is in balance.

ISO standard ISO 03343-1984 can be used as a reference for the basic concept of the residual torque test (900) by the wet twisting method in the aforesaid step 4. Under room temperature, the experimental device is placed into water. The whole experiment is held in water. Finally, the wet twist value of the yarns is used as measuring criteria of the residual torque of the yarns.

The present invention has been experimented on a Zinser-319 type ring spinning machine for many times, and a satisfying result is attained The experimental material is 100% pure cotton rove, which parameters are listed in Table 1. The rotating speed of the spindle of the ring spinning machine is 7000 r/min The single yarn count is 30 tex. Yarns of three different twist multiplier (1.9, 2.4 and 3.1) are used for spinning.

TABLE 1

| | |
|---|---|
| Count of roving | 538 tex |
| Evenness | 3.84 Cvm% |
| Fibre fineness | 0.17 tex |
| Fibre length | 28 mm |
| Elongation percentage | 5.6% |

In the experiment, the selected fibre bundle-splitting mechanism (300) is installed on the drafting frame of the ring spinning machine and driven by the friction of the front roller to rotate. The fibre bundle-splitting mechanism (300) can continuously and smoothly splits the roving into three sub-fibre bundles. A false twister (600) is chosen to be used and installed on the steel collar between the front roller and ring traveller of the ring spinning machine. The false twister (600) rotates to drive the yarns inside the curve grooves to twist. Wet twisting method is used to test the residual torque of the resultant yarn sample, and then the rotating speed of the false twister (600) is regulated according to the amount of residual torque of the resultant yarn sample. In the experiment, with regard to each twist multiplier, when the rotating speed of the false twister (600) is increased to 20000 r/min, the internal torque of the yarns would be in balance.

With regard to each twist multiplier, a conventional single yarn and a single torque-free yarn having a three-fibre bundle structure are processed respectively for comparison. In Practice, under conventional spinning, i.e. without installing a false twister, with regard to a low twist multiplier as 1.9, broken ends would occur to the yarns, thus spinning cannot be go on normally. For all twist multiplier, the progress for single torque-free yarns are smoothly. The residual torque of the different yarn by the experiments and the main properties are listed in Table 2, wherein "X" means yarns cannot be normally processed.

According to Table 2, the residual torque of all the single torque-free ring yarns has reached zero, thus accomplished the satisfying balance result. Comparing to conventional single ring yarn of corresponding twist multiplier, the strength and elongation percentage of single torque-free ring yarns are lower. However, said difference would not affect the processing quality of the latter product. Comparing to conventional single ring yarn of corresponding twist multiplier, the evenness and hairiness of single torque-free ring yarns are improved. In addition, the processing method of single torque-free ring yarns can process yarns with low twist value 330 tpm, which cannot be processed normally by the conventional ring spinning.

What is claimed is:

1. A method of processing singles torque-free ring yarn, comprising:

(a) prior to a spinning triangular zone, using a fibre bundle-splitting mechanism to split a roving into two or more sub-fibre bundles;

(b) attaining each said sub-fibre bundle with a twist value in the spinning triangular zone by a false twister located between a fibre bundle converging point and a ring traveler of a ring spinning machine, then twisting the sub-fibre bundles together to form a singles yarn at the converging point;

(c) passing the singles yarn through the false twister, and each said sub-fibre bundle inside the yarn being reverse twisted with the singles yarn composed thereof to have a reversed twisted value between the false twister and the ring traveler of the ring spinning machine and finally are wound on the spindle of the spinning machine.

2. The method of processing singles torque-free ring yarn of claim 1, characterized in that, processing the singles yarn with controllable splitting-fibre bundle structure, and making the sum of residual torque $$\sum_{j=1}^{N} M_j - M = 0.$$

generated by the N-fibre bundles in the yarn balance with the residual torque (M) of the whole resultant singles yarn, i.e.

$$\left(\sum_{j=1}^{N} M_j\right).$$

3. A production apparatus of singles torque-free ring yarn, wherein a fibre bundle-splitting mechanism and a false twister are installed onto a conventional ring spinning

TABLE 2

| Type of yarns | twist multiplier | twist (tpm) | Test of residual torque with wet twisting method (turns/25 cm) | strength (cN/text) | Elongation percentage (%) | Evenness (%) | Hairiness (–) |
|---|---|---|---|---|---|---|---|
| Conventional single ring yarn | 1.9 | 330 | x | x | x | x | x |
| | 2.4 | 417 | 33.9 | 21.3 | 6.2 | 10.8 | 7.6 |
| | 3.1 | 539 | 47.9 | 24.9 | 6.4 | 10.3 | 6.5 |
| Single torque-free ring yarn | 1.9 | 330 | 0 | 18.2 | 5.0 | 9.8 | 6.6 |
| | 2.4 | 417 | 0 | 21.3 | 5.7 | 9.9 | 5.8 |
| | 3.1 | 539 | 0 | 20.4 | 5.4 | 10.0 | 4.8 |

machine; the roving are split into a plurality of sub-fibre bundles using the fibre bundle-splitting mechanism; with the false-twisting of the false twister, the twisting direction of each sub-fibre bundle in a resultant yarn being opposite from the singles yarn composed thereof, and the residual torque generated by each sub-fibre bundle being balancing with the residual torque of the singles yarn composed thereof.

4. The production apparatus of singles torque-free ring yarn of claim 3, characterized in that, said fibre bundle-splitting mechanism being a multi-fibre bundle-splitting mechanism (300) that is installed on a drafting frame of a ring spinning machine and driven by the friction of a front roller of the spinning machine to rotate; a plurality of annular distributed continuous flutes are provided on rollers of the multi-fibre bundle-splitting mechanism (300), which can split the roving into a plurality of sub-fibre bundles continuously and smoothly.

5. The production apparatus of singles torque-free ring yarn of claim 3, characterized in that, said fibre bundle-splitting mechanism being a double-stage multi-bundle spitting mechanism (2000) that is composed of a double-bundle separate-feeding mechanism (100) installed preceding a yarn drawing/drafting zone and a multi-bundle spilling mechanism (200 or 300) positioned between the yarn drawing/drafting zone and the spinning triangular zone; the double-stage multi-bundle spilling mechanism (2000) has a double stage yarn roving triangular zone, where the first stage spinning triangular zone is to twist several sub-fibre bundle (4000) of the two bundle of roving respectively into two groups of sub-fibre bundles (5100 and 5200), and the second stage spinning triangular stage is to twist the two groups of fibre bundles (5100 and 5200) twisted at the first stage spinning triangular zone into a yarn (6000).

6. The production apparatus of singles torque-free ring yarn of claim 3, characterized in that, the false twister (600) is installed on the steel collar and located between a front roller and a ring traveller of the ring spinning machine; the false twister (600) is composed of two cylinder-halves provided with curve flutes, which can be opened and closed for installing yarn, the false twister (600) rotates to drive the yarn inside the curve flutes to be twisted.

* * * * *